US005337424A

United States Patent [19]

Strack et al.

[11] Patent Number: 5,337,424

[45] Date of Patent: Aug. 16, 1994

[54] SHOWER ENCLOSURE

[75] Inventors: Ludger Strack, Huerth-Efferen; Konrad Bergmann, Wittlich; Klaus Laeller, Meckenheim, all of Fed. Rep. of Germany

[73] Assignee: Ideal-Standard GmbH, Bonn, Fed. Rep. of Germany

[21] Appl. No.: 965,433

[22] Filed: Oct. 23, 1992

Related U.S. Application Data

[62] Division of Ser. No. 573,001, Oct. 29, 1990, Pat. No. 5,274,857.

[30] Foreign Application Priority Data

Dec. 23, 1988 [DE] Fed. Rep. of Germany ..... 3843510
Dec. 23, 1988 [DE] Fed. Rep. of Germany ..... 3843512

[51] Int. Cl.[5] ..... A47K 3/02

[52] U.S. Cl. ..... 4/557; 4/607; 160/113; 160/213

[58] Field of Search ..... 4/557, 558, 607, 608, 4/552; 160/113, 117, 118, 199, 206, 213

[56] References Cited

U.S. PATENT DOCUMENTS

| | | | |
|---|---|---|---|
| 1,148,970 | 8/1915 | King | 4/558 X |
| 1,815,291 | 7/1931 | Druckenmiller | 4/552 |
| 2,079,770 | 5/1937 | Robinson . | |
| 2,380,665 | 7/1945 | Morris | 4/558 X |
| 2,508,970 | 5/1950 | Richardson | 4/552 |
| 5,123,129 | 6/1992 | Lyons | 160/117 X |

FOREIGN PATENT DOCUMENTS

| | | | |
|---|---|---|---|
| 0018299 | 10/1980 | European Pat. Off. | 4/552 |
| 0063512 | 1/1892 | Fed. Rep. of Germany . | |
| 501727 | 3/1968 | Fed. Rep. of Germany . | |
| 1283469 | 11/1968 | Fed. Rep. of Germany . | |
| 1949739 | 8/1970 | Fed. Rep. of Germany . | |
| 2006084 | 8/1971 | Fed. Rep. of Germany . | |
| 7136251 | 9/1971 | Fed. Rep. of Germany . | |
| 7838258 | 6/1979 | Fed. Rep. of Germany . | |
| 3008228 | 9/1981 | Fed. Rep. of Germany | 4/607 |
| 85215828 | 10/1985 | Fed. Rep. of Germany . | |
| 3509732 | 9/1986 | Fed. Rep. of Germany . | |
| 923768 | 7/1947 | France . | |
| 569462 | 11/1975 | Switzerland . | |

*Primary Examiner*—Charles E. Phillips
*Attorney, Agent, or Firm*—Sixbey, Friedman, Leedom & Ferguson

[57] ABSTRACT

A shower partition of the type which is attached to a wall and which can be swiveled as well as swung open and closed, between a rest position and an open position in which the shower partition forms an enclosed shower stall in conjunction with the wall to which it is attached. The shower partition includes a pair of separate subunits, each of which includes a plurality of segments which are hinged with one another. A first end of each subunit is attached to the wall in spaced apart relationship with respect to the first end of the other subunit, and opposite, second ends of the subunits abut one another, when opened, to form the shower stall. When the subunits are opened to form the shower stall, the inner segments are able to fold outward to the rest position while the outer segments are able to fold inward into the rest position but are blocked from folding further outward. Locking elements are attached on the longitudinal edges of the outer segments which engage with one another when the subunits are opened to form the shower stall and which are disengageable from one another only by inwardly directed folding of the outer segments.

5 Claims, 4 Drawing Sheets

SHOWER ENCLOSURE

This is a divisional application of Ser. No. 07/573,001, filed Oct. 25, 1990, now U.S. Pat. No. 5,274,857.

BACKGROUND OF THE INVENTION

The invention relates to a bath and shower device with a bathtub and a related shower partition attached to a wall above the upper edge of the bathtub, wherein the bathtub has, on the bottom, a plane base and wherein the shower partition consists of several segments that are hinged to one another and which are fastened to the well to be able to swing and to fold from an unfolded shower position, forming a shower stall, into a rest position folded on the wall, freeing the bathtub, and vice versa. The invention also relates to a bathtub by itself, especially for use in such a bath and shower device, as well as a shower partition by itself, also especially for use in such a bath and shower device.

Math and shower devices of the type in question are known (German Utility Model Nos. 7 838 258, 1 997 830). With the bathtub of the known bath and shower device, from which the invention originates, the base on the bottom of the bathtub is provided on one end of the bathtub. The user's freedom of movement is restricted there. Moreover, the user can take a comfortable reclining position only at the end opposite the base. In the known bath and shower devices, the shower partition can be a shower curtain or a solid partition, known in the art, consisting of several hinged segments. With a solid shower partition, the segments in any case are fastened to swing on a wall. However, these known solid shower partitions can be used only in corner areas, by which again the user's freedom of movement is restricted. Further, the segments of the shower partition hardly offer any support if a user should slip in the bathtub, so that injuries occur often in such cases.

SUMMARY OF THE INVENTION

An object of the invention is to improve a bath and shower device of the type in question with regard to shower and safety engineering. Another object of invention is also to provide a bathtub of improved configuration that is not only usable in such a bath and shower device but is also independently universally usable. Finally, a further object of the invention is to configure a shower partition so as to be usable such a bath and shower device and to also be universally usable independently of such a bath and shower device, especially in connection with shower bases.

The objects indicated above are achieved in a bath and shower device having a bathtub and a related shower partition attached to a wall above an upper edge of the bathtub and in which the bathtub has a planar base on its bottom and the shower partition is formed of several segments that are hinged to one another so as to be able to swing and fold, by the base, viewed in the longitudinal direction of the bathtub, being placed approximately in the center of the bottom. With regard to the shower partition, the shower partition correspondingly comprises one subunit or two subunits, which in the shower position forms/form with the wall to which if/they is/are fastened a shower stall, is closed on all sides.

In regard to the bathtub, by the central arrangement of the base, the user's freedom of movement is considerably greater than with known bathtubs. Further, the two ends of the bathtub can be configured so that a comfortable reclining position in the bathtub is possible. The configuration of the shower partition according to the invention corresponds to the configuration of the bathtub inasmuch as it creates the conditions for a comfortable shower with great freedom of movement.

The invention is explained below in greater detail with reference to the drawings which represent only illustrative embodiments.

DETAILED DESCRIPTION OF THE PREFERRED EMBODIMENTS

Figure 1:
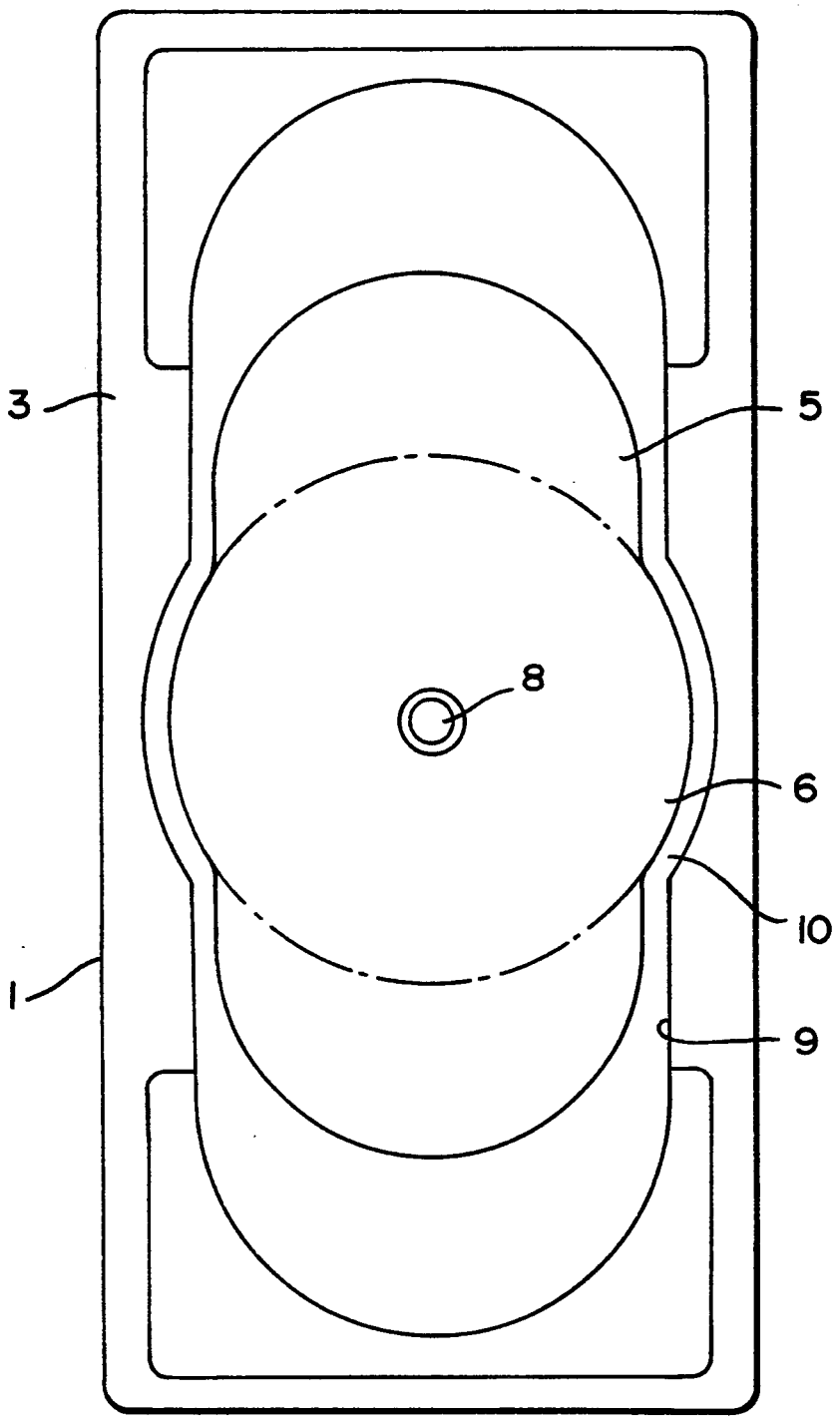
FIG. 1 is a top view of an especially preferred bathtub, especially for a bath and shower device according to the invention.
Figure 2:
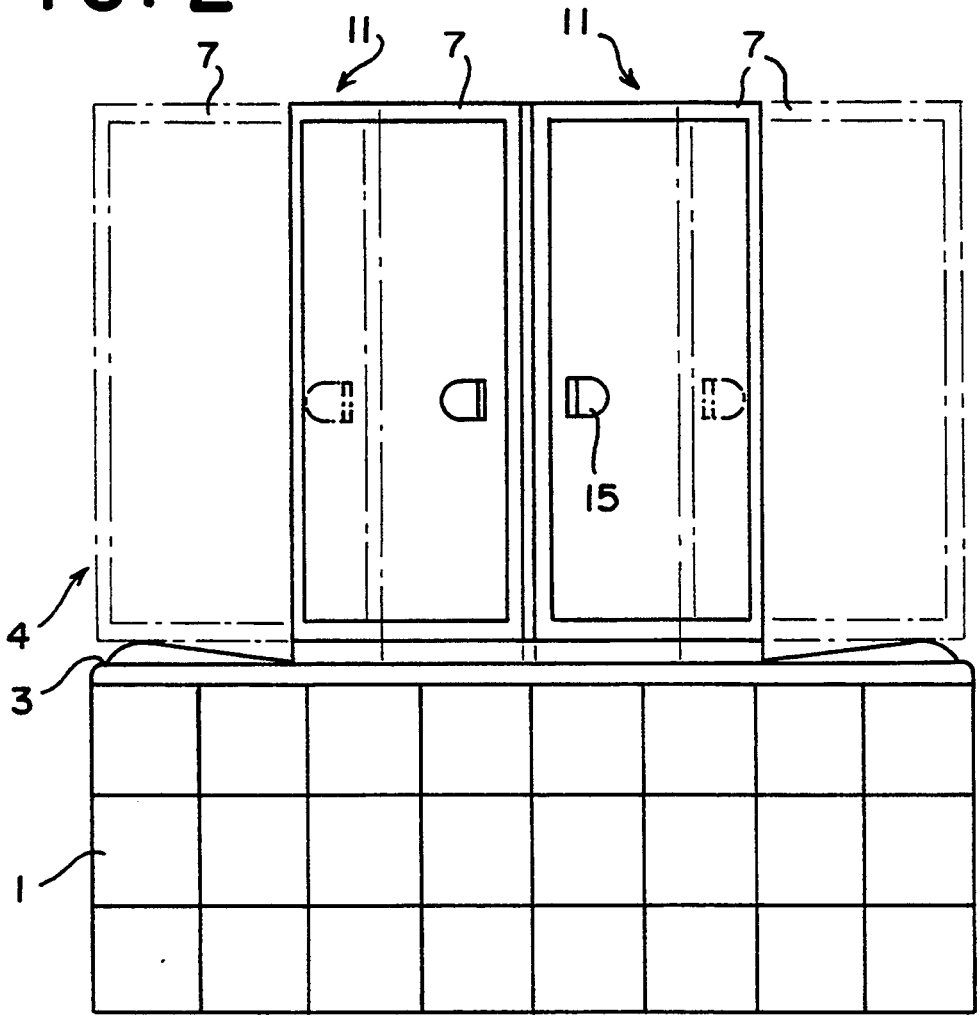
FIG. 2 is a side elevation of a shower partition consisting of two subunits, superposed on a bathtub and in which solid lines show the shower partition in a shower position, while the broken lines show the shower partition in a rest position.
Figure 3:
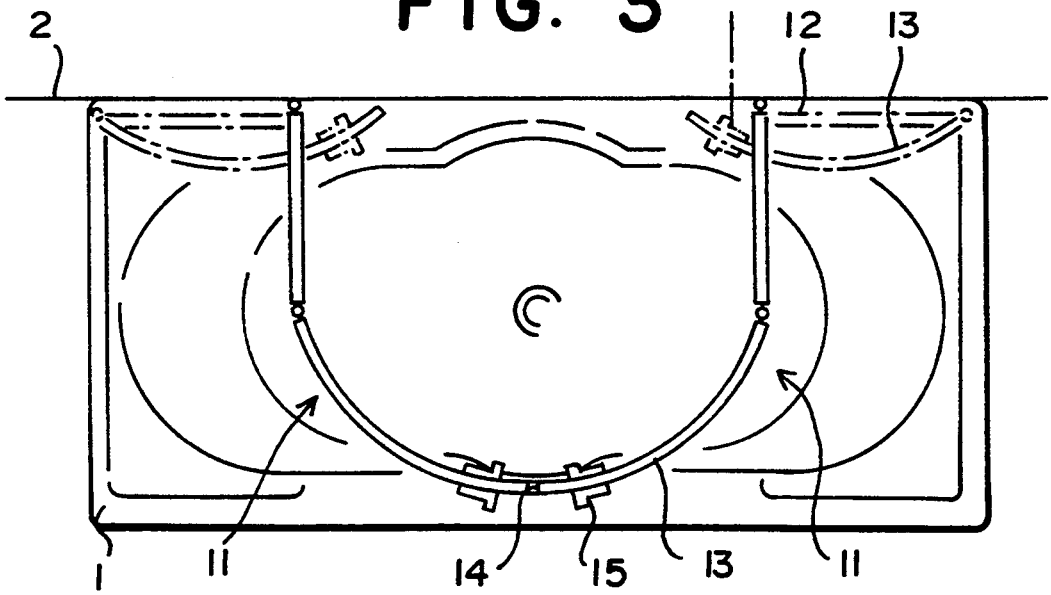
FIG. 3 is a top view of the bath and shower device with bathtub and shower partition of FIG. 2.

First, the basic design of a bath and shower device of the type in question is to be explained in the context of FIG. 1 and FIGS. 2 and 3. Such a bath and shower device comprises a bathtub 1 and a related shower partition 4 which is attached to wall 2 above upper edge 3 of bathtub 1. The bottom 5 of bathtub 1 has a planar base 6. Shower partition 4 consists of several segments 7 that are hinged to one another, and which are fastened on the wall 2 to be able to swing and fold from a unfolded shower position forming a shower stall, represented in FIG. 3 in solid lines, into a rest position, represented in FIG. 3 in broken lines and vice versa. In the rest position, the segments 7 are folded against wall 2, thereby freeing bathtub 1.

In regard to bathtub 1, which is represented in top view in FIG. 1, first base 6, seen in the longitudinal direction of bathtub 1, is placed approximately in the center of bottom 5. Bathtub 1, thus, is designed in the same way in both end areas for a user's comfortable reclining position, in other words, configured altogether centrosymmetrical. A drain 8 is located in the center of base 6. Moreover, for an improved freedom of movement of a user, side walls 9, running in the longitudinal direction of bathtub 1, optionally including upper edge 3 in the area of base 6 are provided with curvatures 10 reaching to bottom 5, so that base 6 is laterally correspondingly enlarged. Further, side walls 9 in the area of base 6, especially in curvature 10, rise steeply from the bottom, preferably at an angle of at least 80°.

The configuration of bathtub 1, explained above, which can especially well be seen in FIG. 1, provides a user with a sufficiently large shower space in the center of bathtub 1, where also bottom 5 of bathtub 1 is largely planar, and more or less merges at an angle into side walls 9. Thus the danger of an accident in this area is systematically minimized.

To be able to take a comfortable bath position in bathtub 1, bottom 5 of bathtub 1, from the base 6 in the center, rises toward both ends or bathtub 1 in stages that gently merge into one another. This is indicated in FIGS. 1 and 3, with the represented curved lines.

Further details can be seen in FIGS. 2 and 3 relative to the configuration of shower partition 4 in a first preferred embodiment. In appropriate adaptation of bathtub 1 represented in FIG. 1, first in the embodiment represented here, shower partition 4 is placed approximately in the center of bathtub 1. Thus, generally, shower partition 4 comprises one or two subunits 11 which, in the shower position, create a shower stall that is closed on all sides in conjunction with wall 2, upon which the partition 4 is fastened. This shower position is represented in solid lines in FIG. 3.

The preferred embodiment of a shower partition represented in FIGS. 2 and 3, first, is characterized in that shower partition 4 consists of two separate subunits, each of which has at least two segments 12, 13. Each inner segment 12 of each subunit 11 is fastened to wall 2 and each of the other, outer (or outermost) segments 13 of both subunits 11 can be tightly applied against one another at their free longitudinal edges 14. As is known in the art, free longitudinal edges 14 of segments 13, for sealing purposes, can be provided with elastic sealing strips. Further, as is known in the art, magnetic locking strips or the like can be attached on longitudinal edges 14 for anchoring them in the shower position. Usual handle elements 15 on the outside and inside can also be seen in FIGS. 2 and 3.

As can be especially clearly seen in FIG. 3, in the represented embodiment, inside segments 12 of subunits 11 of shower partition 4 are configured as straight segments, while outside segments 13 are designed as curved segments, here they extend over an arc of approximately pi/2. Further, since, as represented, inner segments 12 are shorter than outside segments 13, an attractive possibility of folding on wall 2 results, as represented for the rest position in broken lines in FIG. 3.

To prevent an unintentional folding-in of inner segments 12, it is advisable for the position of inner segments 12 in the shower position to be defined by a stop or the like. Thus, the two inner segments 12 can be folded from the shower position only in the direction of the rest position but not in the opposite direction.

Figure 6:
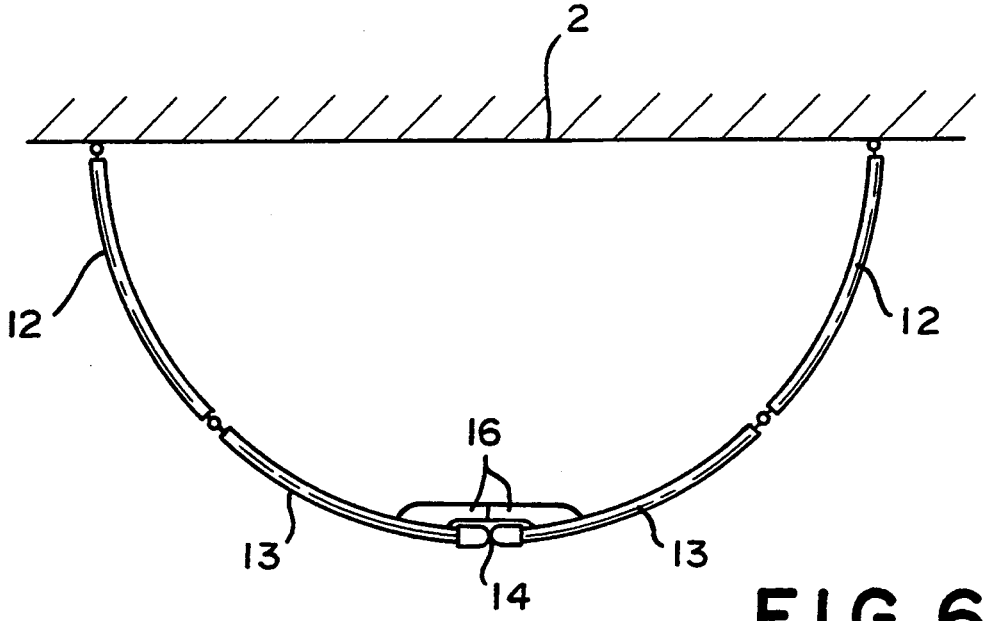
FIG. 6 is a diagrammatic representation of another embodiment to a shower partition consisting of two subunits, here represented in top view independently of a bathtub.
Figure 7:
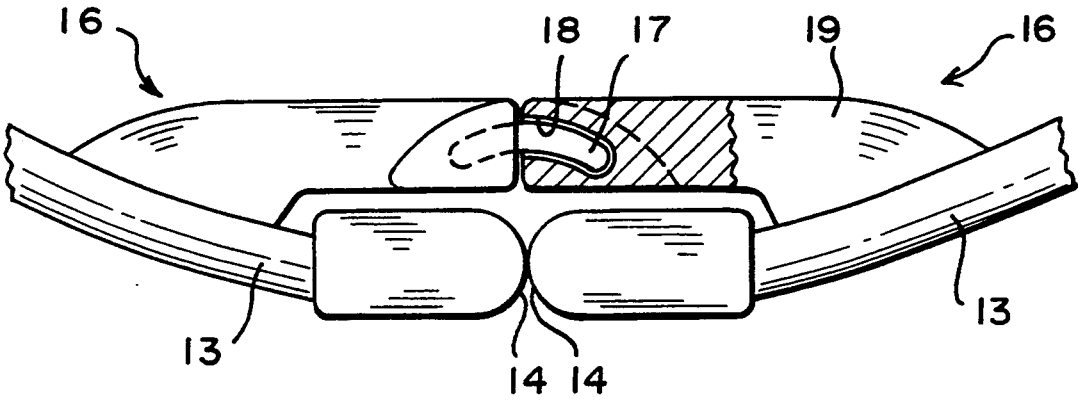
FIG. 7 shows the area of contact of the two subunits of the shower partition of FIG. 6 in an enlarged partial sectional representation.
Figure 8:
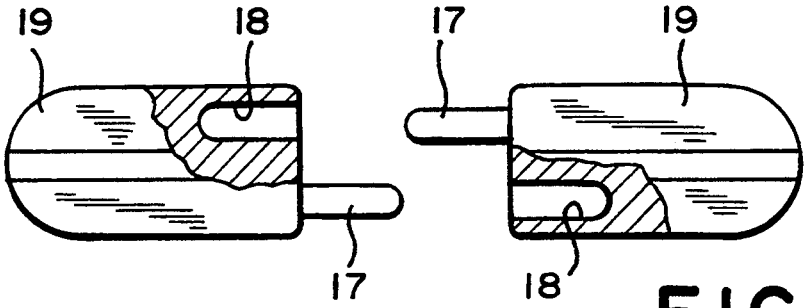
FIG. 8 is a partial sectional view of the special locking elements, used in the shower partition of FIGS. 6 and 7, in a view from inside the shower partition.

The embodiment of a shower partition 4 represented in FIGS. 2 and 3 on bathtub 1 is represented in a separate configuration and not on a bathtub 1, also once more in FIGS. 6, 7 and 8. Here, the difference is first that inside segments 12 of subunits 11 of shower partition 4, like outside segments 13, are also arcuately curved. Such a configuration, for example, is suitable especially for a shower partition 4 placed directly on the floor of a bathroom.

It is essential for the embodiment according to FIGS. 2 and 3, as well as for the embodiment according to FIGS. 6, 7 and 8, first, that the two inside segments 12 be able to fold outward from the shower position to the rest position and the two outside segments 13 be able to fold inward from the shower position to the rest position and that, preferably, outside segments 13 are blocked, in the shower position, from a further outward folding movement. This folding direction of outside segments 13 has the advantage that, basically, outside segments 13, by themselves, do not provide any entry into the shower stall thus formed, so that a user, who totters inside the shower stall, can find support on outside elements 13 without them giving way outwardly.

Prevention of en outward folding movement in the shower position can be achieved by certain stops, fastenings, etc. But, the embodiment represented in FIGS. 6, 7 and 8 is characterized by a special measure, namely, that the locking elements 16 on the longitudinal edges 14 of outside segments 13 engage with each other in the shower position be disengaged from one another by an outwardly directed force acting on outside segments 13 and only an inwardly directed folding movement of outside segments 13 will produce such a disengagement. The configuration of looking elements 16 can, basically, be of a type in the special knowledge of an average expert. However, an expert of average knowledge will normally resort to an active locking by locking elements 16, which would make particular operations of a user necessary. However, this is not optimal, and an automatic locking would be better, which also in emergency situations, i.e., necessary fast opening of shower partition 4 from the outside, represents no obstacle. Here, FIG. 7 shows a special teaching, which is of independently inventive importance, namely the measure that locking elements 16 are made as locking pins 17 and locking openings 18 which are curved against the folding direction. Because of the above-explained movement of outside segments 13 in opening of shower partition 4, locking elements 16, thus configured, easily disengage, if shower partition 4 is normally opened. On the other hand, locking elements 16 are strongly wedged if an outwardly directed force acts on outside segments 13 of shower partition 4.

The locking elements 16 of the embodiment, explained here, could easily be so configured that they are made as continuous strip-like elements from top to bottom. That would, indeed, lead to an additional sealing in the closing area of shower partition 4, but would hardly be justified in cost. Consequently in the represented embodiment it is achieved that locking elements 16 are formed on separate lock supports 19 that are attached to segments 13. The lock supports 19, which can be seen in FIGS. 7 and 8, are especially configured inasmuch as they are made asymmetric with locking pins 17 and locking openings 18 being complementarily shaded relative to one another. This means that only a single lock support 19 needs to be produced, which can be attached to each of segments 13 to achieve the desired locking function, simply by rotating its orientation by 180° from one segment to the other.

Figure 4:
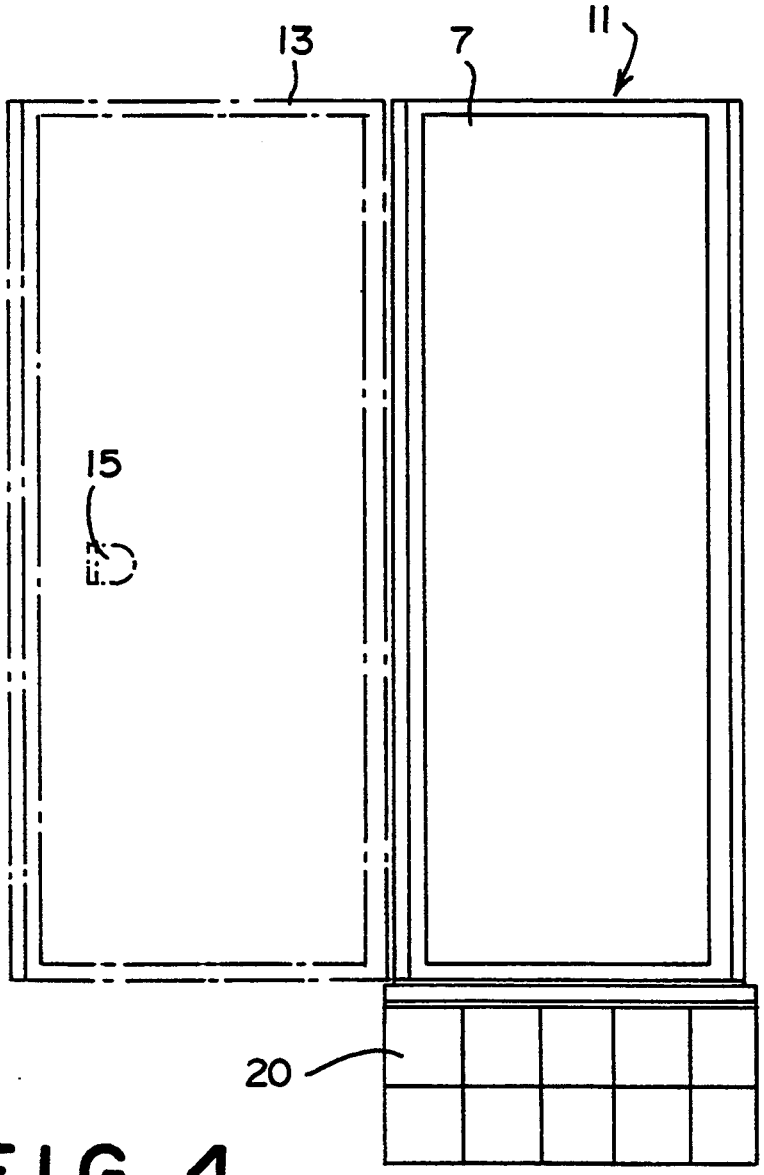
FIG. 4 is an elevational view of another embodiment of a shower partition, but here placed on a shower base, and again, with the shower position shown in solid lines, and the rest position in broken lines.

The above-explained special lock supports 19 offer the possibility at the same time, to achieve inside handle elements 15 instead of using the usual handle elements shown in FIGS. 2–4.

Figure 5:
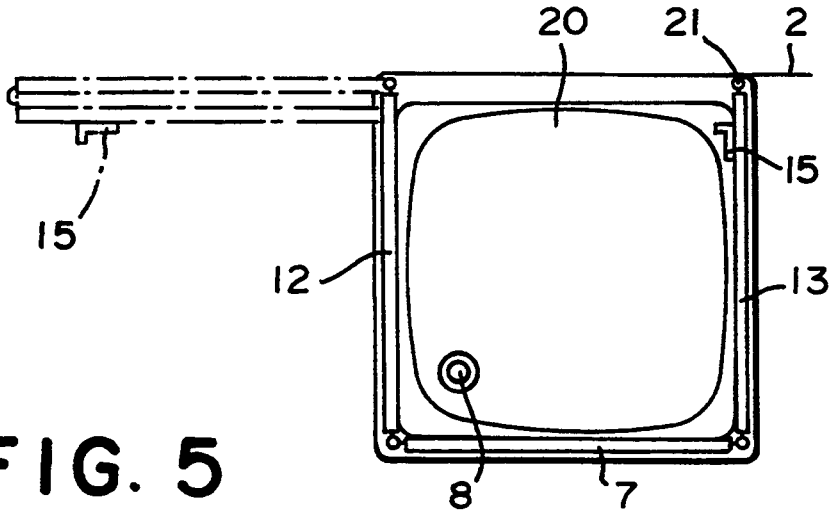
FIG. 5 shows the shower device of FIG. 4 in a top view.

In FIGS. 4 end 5, another embodiment is represented which shows a shower partition 4 on a standard shower base 20. This shower partition 4 consists of a single subunit 11 having at least three segments 12, 7, 13; first segment 12 is fastened wall 2 and third (or last) segment 13 can have its free longitudinal edge tightly applied to wall 2. Shower partition 4, represented here, forms, in the shower position, a shower stall closed on three sides, whose fourth side is wall 2. In the rest position, shower base 20, as represented in FIG. 5 in broken lines, is completely free of shower partition 4, i.e., can be cleaned in an outstanding way.

For stopping free longitudinal edge 14 of outside segment 13 of this shower partition 4 on wall 2, it advisable to provide a wall strip 21 there, whose course corresponds to the course of longitudinal edge 14 of segment 13. Correspondingly suitable sealing strips and magnetic strips, as explained above, can be placed here. Of course, in connection with a shower base 20, a shower partition 4, consisting of two subunits 11, can be provided.

Quite generally, at least one small fastening of segments 7, 12, 13 of shower partition 4 in certain desired positions is advisable. For this purpose, fastening elements, which are not represented here, can be provided at the connecting points. In this case, stops elements, spring-loaded levers or the like can be involved. But these techniques are known from the prior art.

Quite generally, as is known in the art, it is suitable to place, between shower partition 4 and the edge of bathtub 1 or shower base 20, sealing elements made of rubber or plastic which can be held on segments 7, 12, 13. Appropriate sealing elements are also advisable for the transition areas from segment to segment. Such sealing elements can be configured to be skirt-shaped and, for example, can project inward and form drip edges there so that dripping water reliably flows, respectively, into bathtub 1 or shower base 20.

As was already expressly explained in the general part of the description, the above-explained features can also be achieved for bathtubs 1 by themselves or shower partitions 4 by themselves.

We claim:

1. A shower partition of the type which is attached to a wall and which can be swiveled as well as swung open and closed, said shower partition, when opened forming an enclosed shower stall in conjunction with the wall to which it is attached; wherein said shower partition comprises a pair of separate subunits, each of which includes a plurality of segments which are hinged with one another; wherein a first end of each subunit is attached to the wall in spaced apart relationship with respect to the first end of the other subunit; wherein opposite, second ends of the subunits abut one another, when opened, to form the shower stall; and wherein locking elements are attached on the longitudinal edges of the outer segments which engage with one another when the subunits are opened to form the shower stall; wherein each of said subunits comprise at least an inner segment and an outer segment, each inner segment being mounted to the wall, and the outer segments tightly fitting against one another at free longitudinal edges thereof when the subunits are opened to form the shower stall; wherein, when the subunits are opened to form the shower stall, the inner segments are swingable only in a direction toward a rest position in which the subunits are closed against the wall; wherein, when the subunits are opened to form the shower stall, the inner segments are able to fold outward to the rest position and the outer segments are able to fold inward into the rest position and are blocked from folding further outward; and wherein the locking elements are disengageable from one another only by inwardly directing folding of the outer segments.

2. A shower partition according to claim 1, wherein the locking elements are made as locking pins and locking openings which are curved in an opposite direction relative to the folding direction.

3. A shower partition according to claim 2, wherein the lock supports are placed on an inner side of the outer segments and are made as handle elements.

4. A shower partition according to claim 3, wherein the locking elements are made as locking pins and locking openings which are curved in an opposite direction relative to the folding direction.

5. A shower partition according to claim 1, wherein the locking elements are formed separately on lock supports attached to the outer segments.

* * * * *